US012178341B2

(12) United States Patent
Delazio et al.

(10) Patent No.: US 12,178,341 B2
(45) Date of Patent: Dec. 31, 2024

(54) BEVERAGE CAN STRAW HOLDER

(71) Applicant: University of Pittsburgh—Of the Commonwealth System of Higher Education, Pittsburgh, PA (US)

(72) Inventors: Alexandra Marie Delazio, Pittsburgh, PA (US); David M. Brienza, Allison Park, PA (US); Patricia Karg, South Park, PA (US)

(73) Assignee: University of Pittsburgh—Of the Commonwealth System of Higher Education, Pittsburgh, PA (US)

( * ) Notice: Subject to any disclaimer, the term of this patent is extended or adjusted under 35 U.S.C. 154(b) by 731 days.

(21) Appl. No.: 17/357,003

(22) Filed: Jun. 24, 2021

(65) Prior Publication Data

US 2021/0401205 A1 Dec. 30, 2021

Related U.S. Application Data

(60) Provisional application No. 63/043,924, filed on Jun. 25, 2020.

(51) Int. Cl.

| | |
|---|---|
| ***A47G 21/18*** | (2006.01) |
| ***A47G 19/22*** | (2006.01) |
| ***B65D 77/28*** | (2006.01) |

(52) U.S. Cl.

CPC ..... *A47G 21/18* (2013.01); *A47G 19/2222* (2013.01); *B65D 77/28* (2013.01); *B65D 2231/022* (2013.01)

(58) Field of Classification Search

CPC .... A47G 21/18; A47G 21/185; A47G 21/189; A47G 19/2222; A47G 19/2205; A47G 19/2266; A47G 19/2272; B65D 77/28; B65D 77/286; B65D 39/0005; B65D 39/00; Y10S 220/906

USPC ..... 220/212, 709, 707, 705, 906; 215/229, 215/389, 388, 364, 355; D9/440, 439, D9/435

See application file for complete search history.

(56) References Cited

U.S. PATENT DOCUMENTS

| | | | | |
|---|---|---|---|---|
| D788,488 | S | 6/2017 | Terrill | |
| 2002/0008109 | A1* | 1/2002 | Hirota | B65D 51/20 220/709 |
| 2016/0137362 | A1 | 5/2016 | Gorsic | |

FOREIGN PATENT DOCUMENTS

| | | | | |
|---|---|---|---|---|
| FR | 2695910 | A1 * | 3/1994 | B65D 43/0212 |

* cited by examiner

*Primary Examiner* — Robert J Hicks

(74) *Attorney, Agent, or Firm* — BARTONY & ASSOCIATES LLC

(57) ABSTRACT

A device for use with a beverage can to secure a straw thereto includes a base configured to cooperate with an opening of the beverage can to secure the device to the beverage can and a passage formed through the base which aligns with the opening of the beverage can when the device is secured to the beverage can. The passage is configured to pass a straw therethrough.

32 Claims, 12 Drawing Sheets

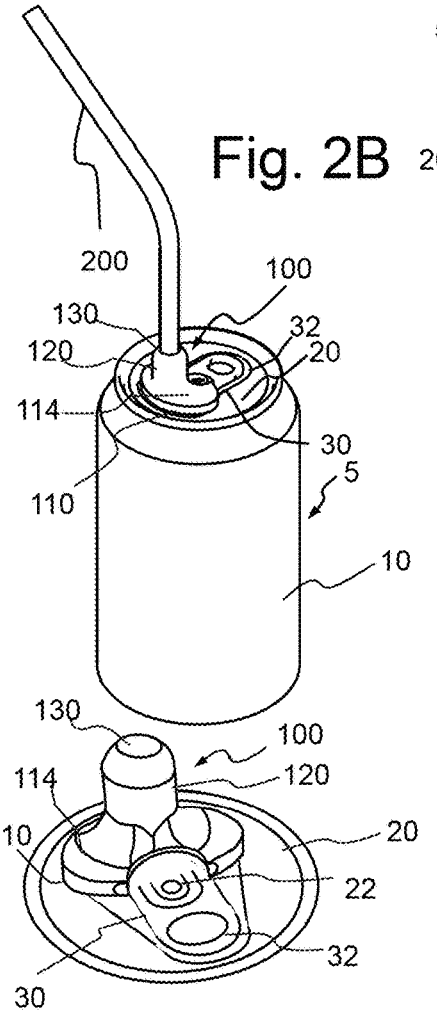
Fig. 2B
Fig. 2C
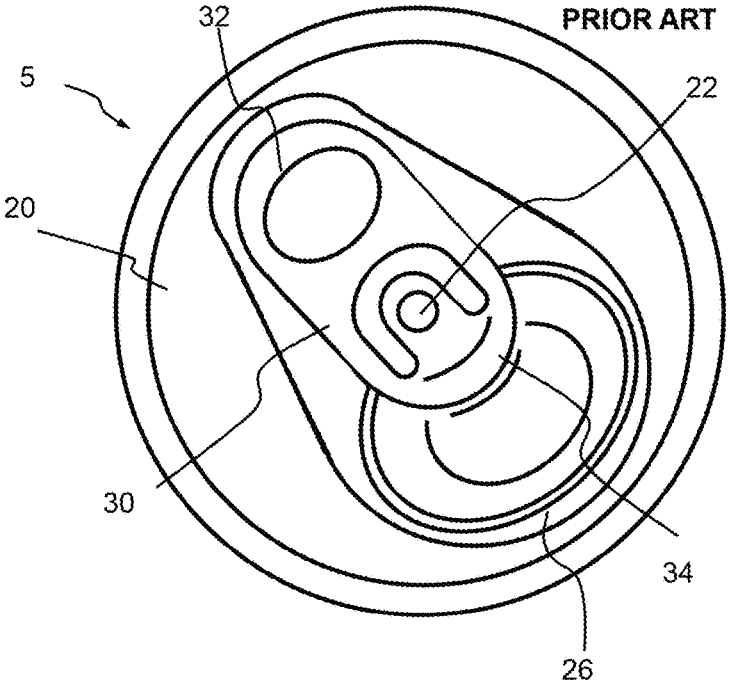
Fig. 1A
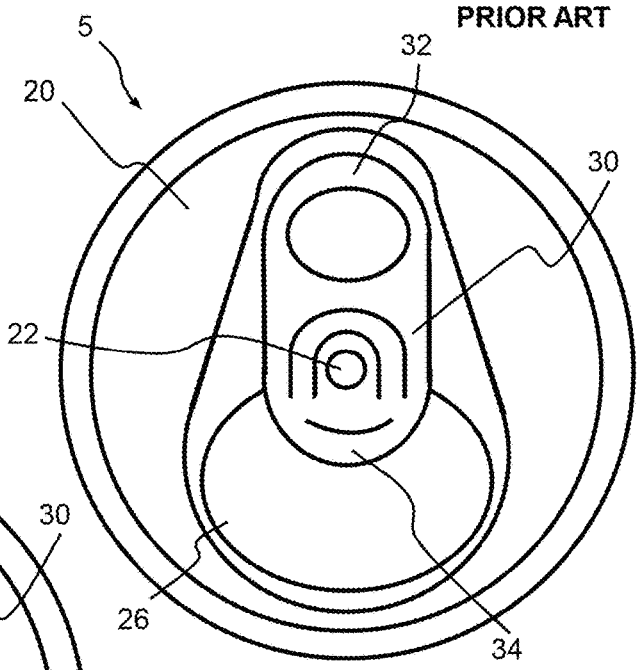
Fig. 1B
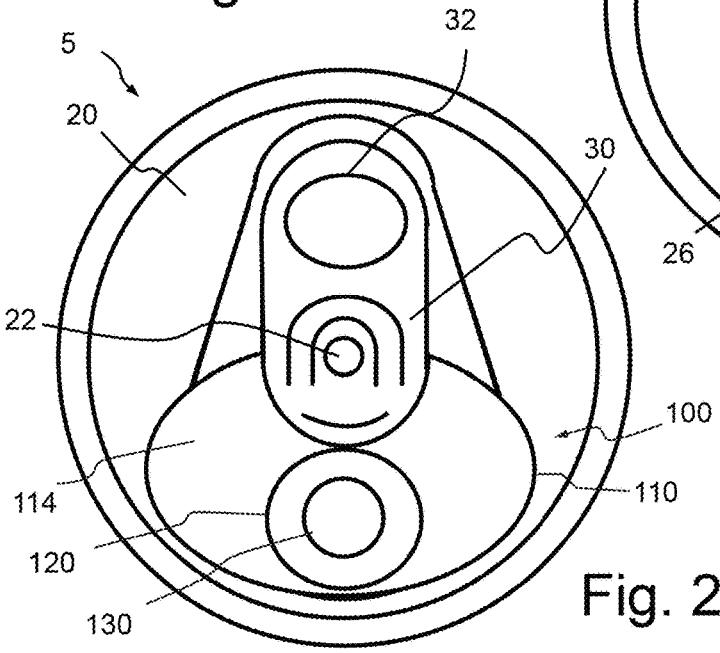
Fig. 2A

Fig. 9A
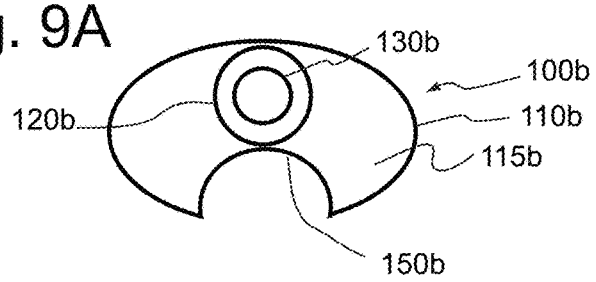
Fig. 9B
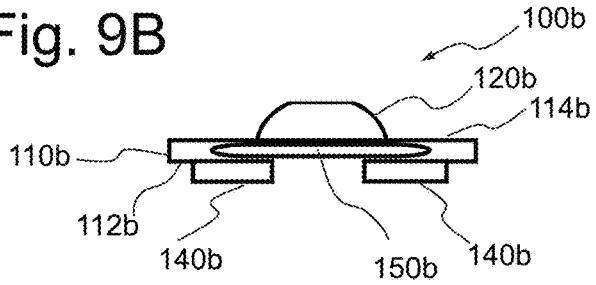
Fig. 9C
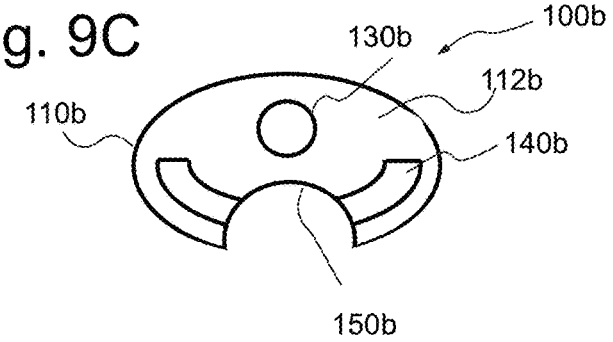
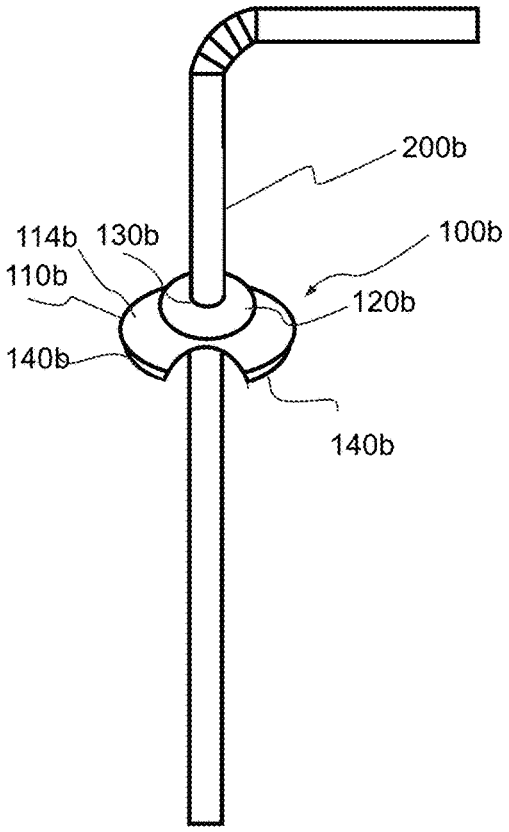
Fig. 9D
Fig. 9E
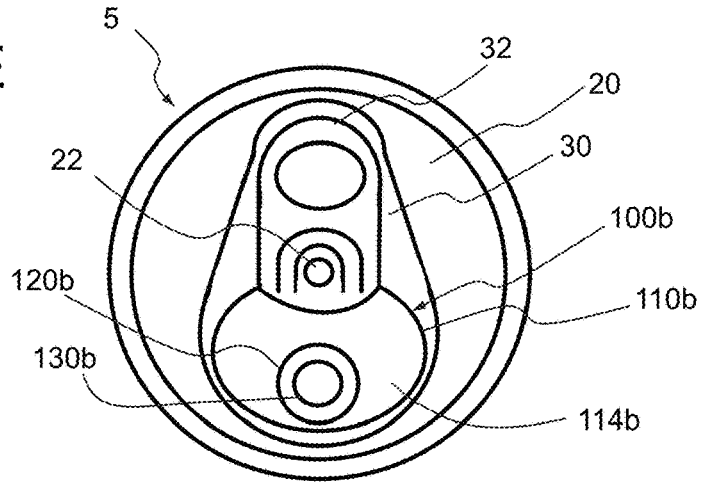

Fig. 12A
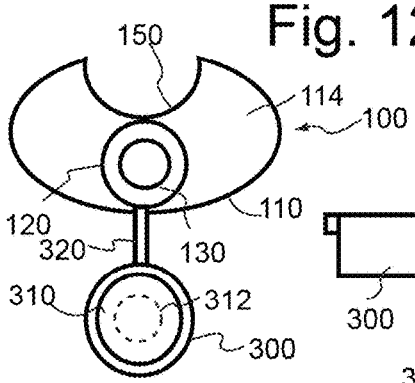
Fig. 12C
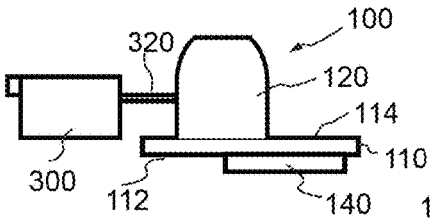
Fig. 12E
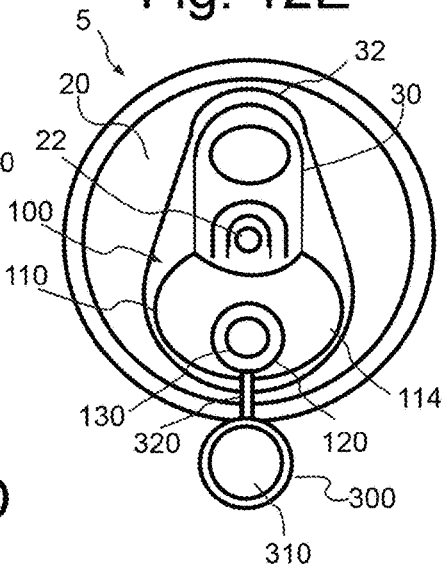
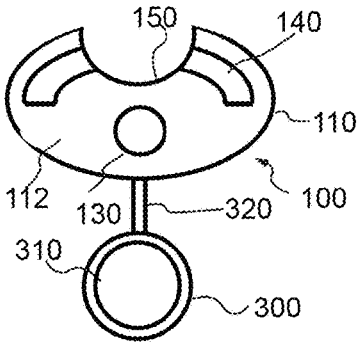
Fig. 12B
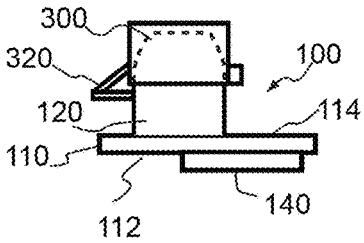
Fig. 12D
Fig. 13A
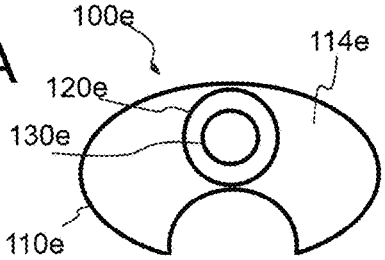
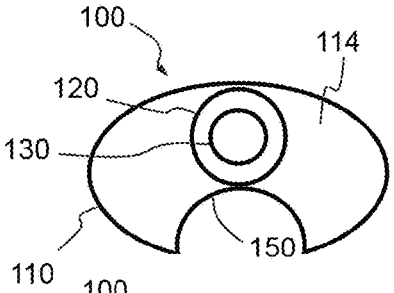
Fig. 13B
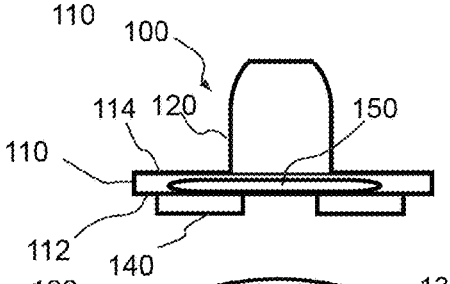
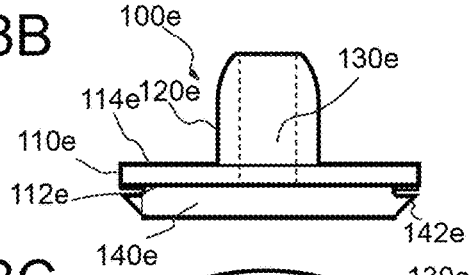
Fig. 13C
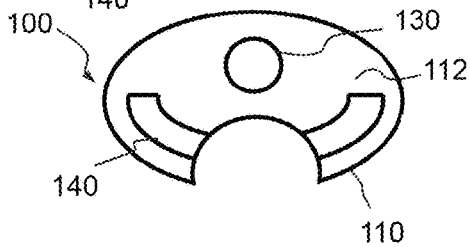
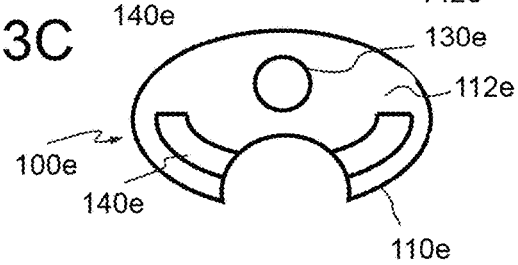

Fig. 14A
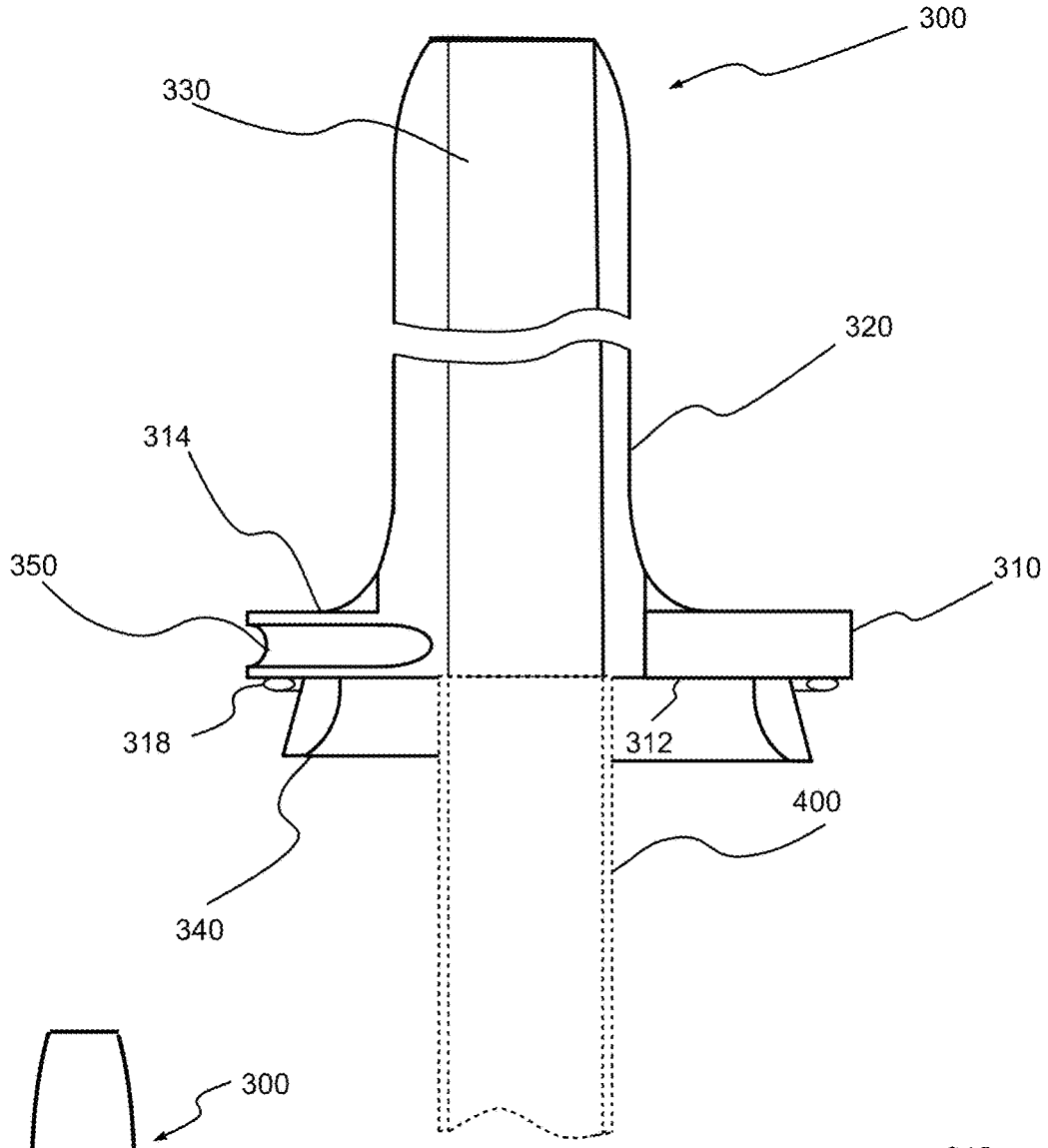
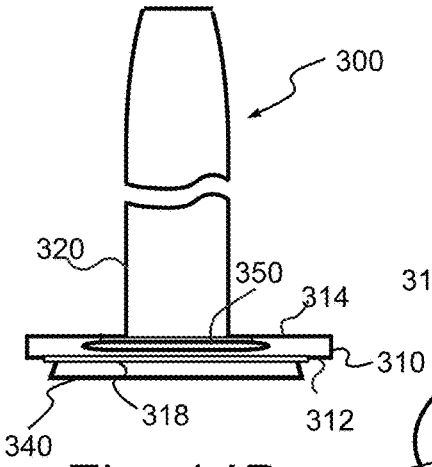
Fig. 14B
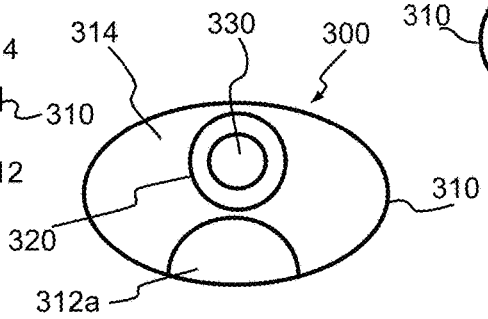
Fig. 14C
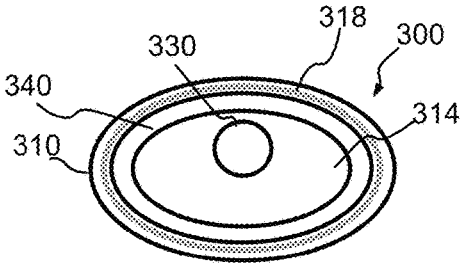
Fig. 14D

BEVERAGE CAN STRAW HOLDER

CROSS-REFERENCE TO RELATED APPLICATIONS

This application claims benefit of U.S. Provisional Patent Application Ser. No. 63/043,924, filed Jun. 25, 2020, the disclosure of which is incorporated herein by reference.

BACKGROUND

The following information is provided to assist the reader in understanding technologies disclosed below and the environment in which such technologies may typically be used. The terms used herein are not intended to be limited to any particular narrow interpretation unless clearly stated otherwise in this document. References set forth herein may facilitate understanding of the technologies or the background thereof. The disclosure of all references cited herein are incorporated by reference.

As illustrated in FIGS. 1A through 1B, modern beverage cans 5, which are typically manufactured from aluminum include a body 10 and a lid 20. Beverage cans 5 are very often used in connection with sodas. The center of lid 20 is typically stretched upward slightly and drawn by a fabrication machine to form a rivet 22. A pull tab 30, which is formed from a separate piece of metal, is inserted under rivet 22 and secured by it. Lid 20 is scored in the form of an opening 26 so that when a first end 32 of tab 30 is pulled upward by the consumer, second end 34 of tab 30 place downward force of the scored metal of opening 26 which will at least partially detach relatively easily and leave opening 26 as illustrated in FIG. 1B.

A number of devices have been created to connect to and cooperate with beverage cans 10 for a variety of purposes. For example, beverage can toppers are available which latch onto the top of the beverage can/lid 20 and seal beverage can 10 when not in use. Another device attaches to the top of the can opening 26 and includes a spout-like mechanism from which users may drink from beverage can 10. Still another device includes a snap-on bottle top to give beverage can 10 a bottle top which twists on and off.

Straws are often used in connection with beverage cans 10 by inserting the straw in opening 26 of beverage can 10. However, straws often pop out and move within and from beverage can 10 when beverage can 10 is manipulated. This presents problem to all drinkers but is especially problematic for those with limited dexterity and/or limited range of motion, such as young children, the elderly and those of limited or impaired mobility.

SUMMARY

In one aspect, a device for use with a beverage can to secure a straw includes a base configured to cooperate with an opening of the beverage can to secure the device to the beverage can and a passage formed through the base which aligns with the opening of the beverage can when the device is secured to the beverage can. The passage is configured to pass a straw therethrough. The device may further include at least one flange extending from a first surface or side of the device to cooperate with the opening. In a number of embodiments the at least one flange forms a snap fit or a friction fit with the opening.

In a number of embodiments, the base is further configured to cooperate with a tab of the beverage can. The device may, for example, further include at least one seating formed in the base to cooperate with an end of the tab. The at least one seating may, for example, include a slot formed in the base.

In a number of embodiments, the device further includes an extending member which extends from a second surface or side of the base, opposite the first surface or side. The passage may be formed through the extending member and through the base. The passage may, for example, form a friction fit or an abutting fit with the straw. The passage may, for example, be formed to abut and retain the straw or the device may further include an abutment member or retainer in operative connection with the passage to abut and retain the straw. In a number of embodiments, the passage includes a taper over at least a portion of the surface thereof so that the passage narrows to abut and retain the straw.

The device may further include a cap to seal the passage. The cap may, for example, be tethered to the device.

In another aspect, a method of securing a straw within a beverage can include securing a device to the beverage can which comprises a base configured to cooperate with an opening of the beverage can to secure the device to the beverage can and a passage formed through the base which aligns with the opening of the beverage can and inserting a straw into the passage. In a number of embodiments, the device further includes at least one flange extending from a first surface or side of the device to cooperate with the opening. The at least one flange may, for example, form a snap fit or a friction fit with the opening.

In a number of embodiments, the base is further configured to cooperate with a tab of the beverage can. The device may, for example, further include at least one seating formed in the base to cooperate with an end of the tab. The at least one seating may, for example, include a slot formed in the base.

In a number of embodiments, the device further includes an extending member which extends from a second surface or side of the base, opposite the first surface or side, wherein the passage is formed through the extending member and the base. The passage hereof may, for example, form a friction fit or an abutting fit with the straw. As set forth above, the passage may, for example, be formed to abut and retain the straw or the device may further include an abutment member or retainer in operative connection with the passage to abut and retain the straw. In a number of embodiments, the passage includes a taper over at least a portion of the surface thereof so that the passage narrows to abut and retain the straw.

In a number of embodiments, the method further includes placing a cap in connection with the device to seal the passage. The cap may, for example, be tethered to the device.

In another aspect, a device for use with a beverage can includes a base configured to cooperate with an opening of the beverage can to secure the device to the beverage can, an extending member extending from an upper surface of the base, and a passage formed through the extending member and through the base, the passage aligning with the opening of the beverage can when the device is secured to the beverage can. The device may further include at least one flange extending from a lower surface of the base to cooperate with the opening of the beverage can. In a number of embodiments, the upper end of the passage is configured to be placed in the mouth of a user. In a number of embodiments, the device further includes a conduit in fluid connection with the passage and extending from the lower surface of the base.

In another aspect a method of facilitating use of a beverage can includes providing a device including a base configured to cooperate with an opening of the beverage can to secure the device to the beverage can, an extending member extending from an upper surface of the base, and a passage formed through the extending member and through the base, the passage aligning with the opening of the beverage can when the device is secured to the beverage can and placing the device in operative connection with the beverage can.

In a further aspect, a system includes a beverage can and a device as described herein. The device may, for example, be used in connection with the beverage can to secure a straw within the beverage can. In a number of embodiments, the device includes a base configured to cooperate with an opening of the beverage can to secure the device to the beverage can, and a passage formed through the base which aligns with the opening of the beverage can when the device is secured to the beverage can, wherein the passage is configured to pass a straw therethrough.

In a number of embodiments, the device for use with the beverage can includes a base configured to cooperate with an opening of the beverage can to secure the device to the beverage can, an extending member extending from an upper surface of the base, and a passage formed through the extending member and through the base, the passage aligning with the opening of the beverage can when the device is secured to the beverage can.

The present devices, systems, and methods hereof, along with the attributes and attendant advantages thereof, will best be appreciated and understood in view of the following detailed description taken in conjunction with the accompanying drawings.

BRIEF DESCRIPTION OF THE DRAWINGS

FIG. 1A illustrates a top plan view of a beverage can before the tab thereof is used to open the can.

FIG. 1B illustrates another top plan view of the beverage can of FIG. 1A after the tab has been used to open the can.

FIG. 2A illustrates another top plan view of the beverage can of FIG. 1A with an embodiment of a device hereof in operative connection therewith.

FIG. 2B illustrates a top perspective view of a beverage can with the device of FIG. 2A in operative connection therewith to support a straw in operative connection within the can.

FIG. 2C illustrates a top perspective view of the lid of a beverage with the device of FIG. 2A in operative connection with the lid.

FIG. 9A illustrates a top view of another embodiment of a device hereof including an upper extending member having a lower profile than the embodiment of FIGS. 2A through 6C.

FIG. 9B illustrates a front view of the device of FIG. 9A.

FIG. 9C illustrates a bottom view of the device of FIG. 9A.

FIG. 9D illustrates a perspective view of the device of FIG. 9A in operative connection with a straw.

FIG. 9E illustrates a top view of the device of FIG. 9A in operative connection with beverage can.

FIG. 12A illustrates a top view of an embodiment of the device of FIG. 2A further including an attached, integrated or monolithically formed cap to seal the device when not in use.

FIG. 12B illustrates a bottom view of the device of FIG. 12A.

FIG. 12C illustrates a side view of the device of FIG. 12A with the cap disconnected from the extending member of the device.

FIG. 12D illustrates another side view of the device of FIG. 12A with the cap connected to the extending member of the device.

FIG. 12E illustrates a top view of the device of FIG. 12A in operative connection with beverage can with the cap disconnected from the extending member of the device.

FIG. 13A illustrates top views providing a comparison of an embodiment of a device hereof which cooperates with the tab and the opening of a beverage can (as, for example, illustrated in FIGS. 2A through 6C) and an embodiment of a device hereof which cooperates only with the opening of the beverage can to attach the device to the beverage can.

FIG. 13B illustrates rear views of the device of FIG. 13A.

FIG. 13C illustrates bottom views of the devices of FIG. 13A.

FIG. 14A illustrates a side, cutaway view of another embodiment of the device hereof.

FIG. 14B illustrates a front view of the device of FIG. 14A.

FIG. 14C illustrates a top view of the device of FIG. 14A.

FIG. 14D illustrates a bottom view of the device of FIG. 14A.

DETAILED DESCRIPTION

Figure 3:
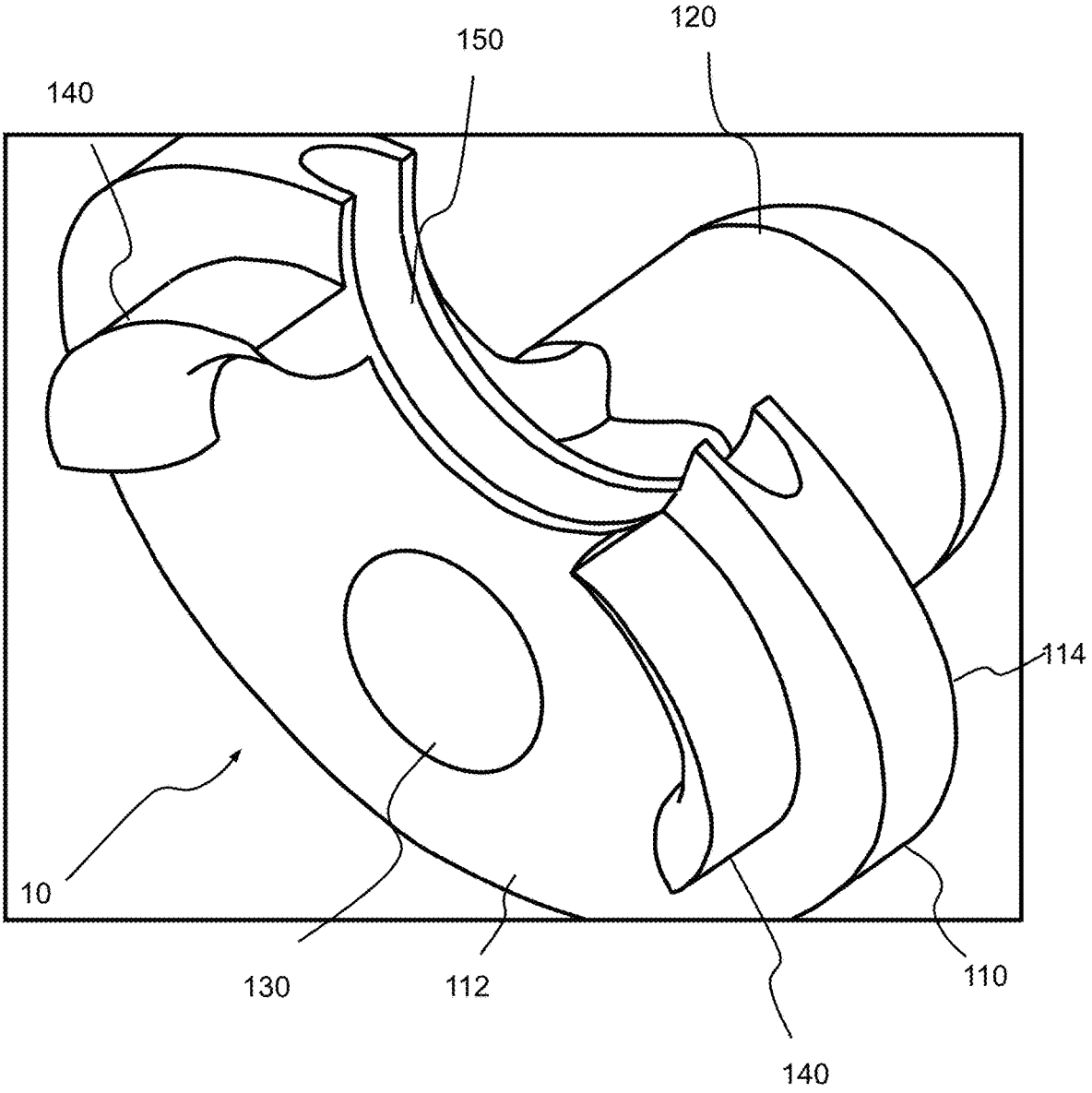
FIG. 3 illustrates a bottom perspective view of the device of FIG. 2A disconnected from the beverage can.
Figure 4:
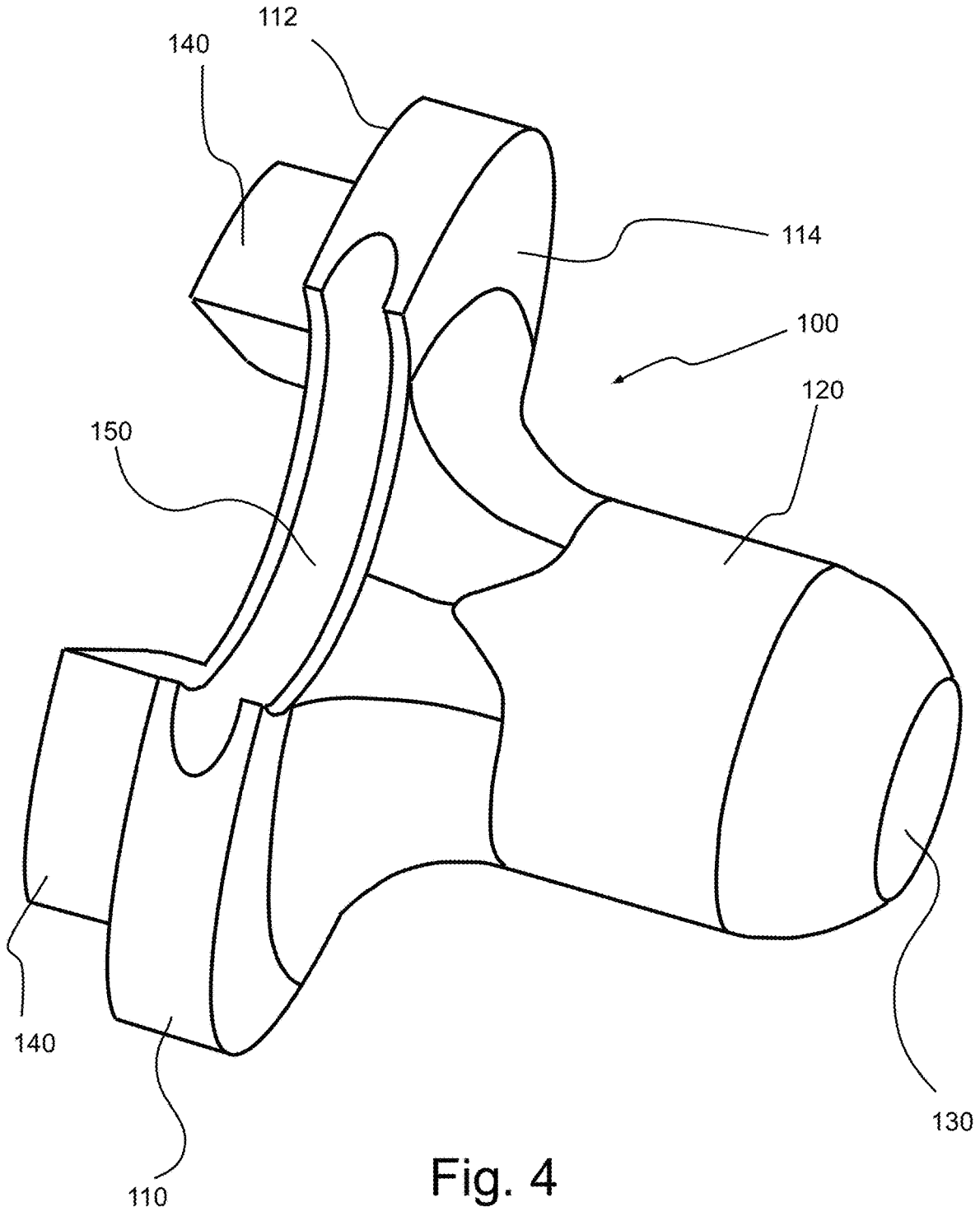
FIG. 4 illustrates a side perspective view of the device of FIG. 2A disconnected from the beverage can.
Figure 5:
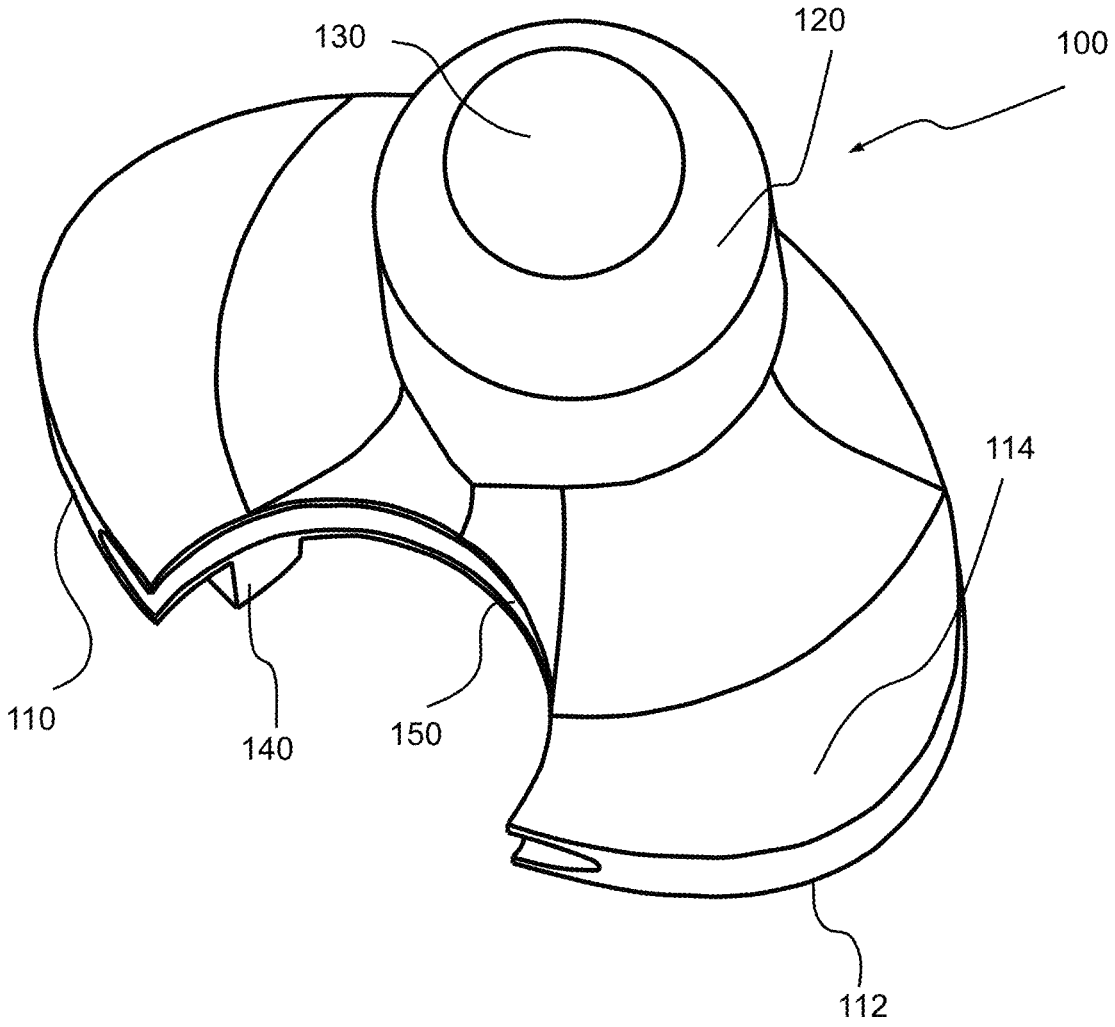
FIG. 5 illustrates a top perspective view of the device of FIG. 2A disconnected from the beverage can.
Figure 6A:
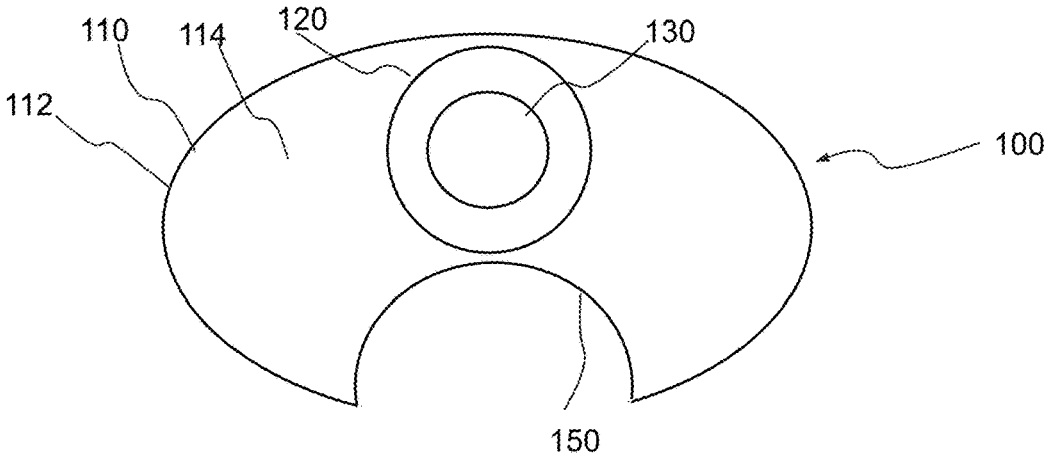
FIG. 6A illustrates a top view of the device of FIG. 2A disconnected from the beverage can.
Figure 6B:
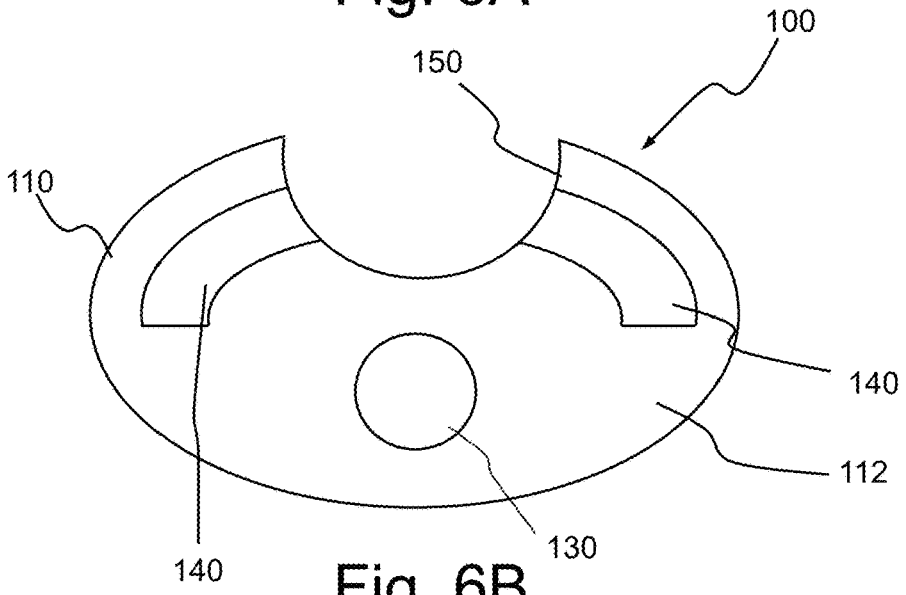
FIG. 6B illustrates a bottom view of the device of FIG. 2A disconnected from the beverage can.
Figure 6C:
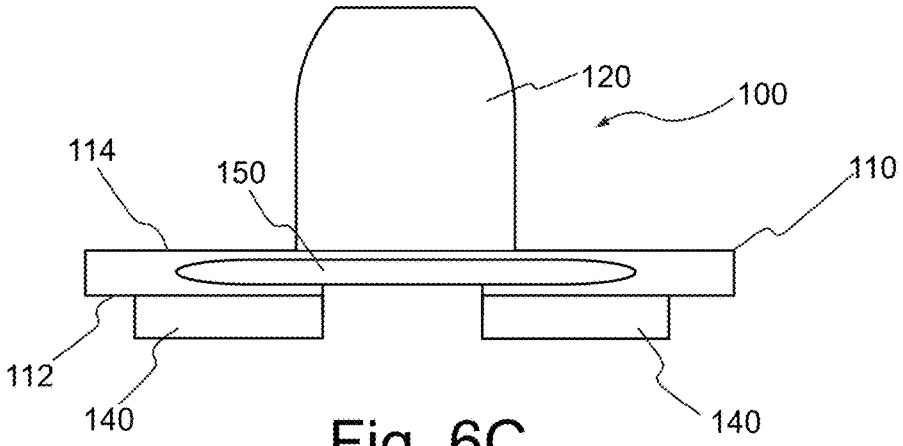
FIG. 6C illustrates a front view of the device of FIG. 2A disconnected from the beverage can held in the hand of a user.

It will be readily understood that the components of the embodiments, as generally described and illustrated in the figures herein, may be arranged and designed in a wide variety of different configurations in addition to the described representative embodiments. Thus, the following more detailed description of the representative embodiments, as illustrated in the figures, is not intended to limit the scope of the embodiments, as claimed, but is merely illustrative of representative embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

As used herein and in the appended claims, the singular forms "a," "an", and "the" include plural references unless the context clearly dictates otherwise. Thus, for example, reference to "a flange" includes a plurality of such flanges and equivalents thereof known to those skilled in the art, and so forth, and reference to "the flange" is a reference to one or more such flanges and equivalents thereof known to those skilled in the art, and so forth. Recitation of ranges of values herein are merely intended to serve as a shorthand method of referring individually to each separate value falling within the range. Unless otherwise indicated herein, and each separate value, as well as intermediate ranges, are incorporated into the specification as if individually recited herein. All methods described herein can be performed in any suitable order unless otherwise indicated herein or otherwise clearly contraindicated by the text.

As used herein, relative, directional terms such as "upward", "downward", "rearward", "forward", "radial", "axial", "horizontal", "vertical" and/or other terms refer to the orientation of a device hereof when used in connection with a beverage can for use by a consumer. Such terms are relative in nature and are not limiting of embodiments hereof unless the context clearly indicates otherwise.

As illustrated in FIGS. 2A through 2C, device 100 hereof is placed in operative connection with a lid 20 and opening 26 of beverage can 10 to support a straw 200 in operative connection with beverage can 10. In a number of embodiments, device 100 is in the form of a relatively small and low-profile insert that cooperates with opening 26 and tab 30 of lid 20 of beverage can 10 to secure straw 200. The cooperation of device 100 with second end 34 of tab 30 of beverage can 10 and securement of the straw insertion location is illustrated in FIGS. 2A through 2C. In general, device 100 makes drinking from beverage can 10 easier by preventing straw 200 from moving within beverage can 10 and from popping out and moving from beverage can 10 when beverage can 10 is manipulated. Device 100 can be beneficially used by all canned beverage drinkers including, but not limited to, those with limited dexterity, limited range of motion, or other limitations (for example, young children, the elderly, physically impaired users, visually impaired users, etc.).

Referring to FIGS. 2A through 6C, device 100 includes a base 110. In a number of embodiments, base 110 includes a lower surface 112 which contacts the upper surface of lid 20 when device 100 is placed in operative connection with beverage can 10. In the embodiment of FIGS. 2A through 6C, an upward extending member 120 extends upward from an upper surface 114 of base 110. A hole or passage 130 to receive straw 200 is formed through device 100, passing through extending member 120 and through base 110.

In the illustrated embodiment, one or more downward extending flanges 140 extend from base 110. Flanges 140 are, for example, spaced and/or dimensioned to pass into opening 26 of beverage can 10 and cooperate with the walls thereof in securing device 100 to beverage can 10. Device 100 further includes a generally horizontally or radially extending slot or seating 150 which is dimensioned to seat second or forward end 34 of tab 30 as, for example, illustrated in FIG. 2A through 2C.

In a number of embodiments, device 100 may, for example, be formed integrally or monolithically from a material such as a polymeric material such as plastics or rubbers. In a number of embodiments, harder, sturdier or more rigid materials (for example, polymers, metals, etc.) may be used to assist in positioning device 100 or other devices hereof in beverage can 10. Further materials suitable for use in devices hereof include paper, cardboard, and/or similar materials. Paper and cardboard embodiments may be used to promote recycling and environmental friendliness. In a number of embodiments, more flexible, rubberlike materials may, for example, be used to provide a corklike suction to seal a device hereof to beverage can 10 with a suitably designed flange and/or seating.

In FIGS. 7A through 7D, a modified version of device 100 is illustrated in which passage 130 includes a first, upper or top opening 132 that is generally circular or circular in cross-section and a second, lower or bottom opening 134 that is generally ovular or ovular in cross-section. First opening 132 allows free passage of straws 200 having a range of diameters therethrough. However, second opening 134 created a pinch point to abut and/or deform the side walls of the straw 200 sufficiently to allow retention of straw 200 but without significantly blocking passage of fluid therethrough. A reduced diameter or dimension of second opening 134 thus operates as a straw retainer. In a number of embodiments, a smooth transition between circular first opening 124 and ovular, elliptical, or stadium-shaped second opening 134 is provided to facilitate passage or straw 200 therethrough. Second opening 134 can have a dimension that is reduced to abut straw 200 in a manner to deform the draw radially inwardly but allow deformable/resilient straw 200 to "expand" in a complimentary direction to prevent formation of a significant restriction in the straw. Straw 200 may, for example, be deformed from a circular cross section to an ovular, elliptical, or stadium-shaped cross section. A smooth transition in passage 130 may, for example, be modeled in various CAD programs via a loft or boundary surface function which creates smooth tangency between selected curves.

Figure 7A:
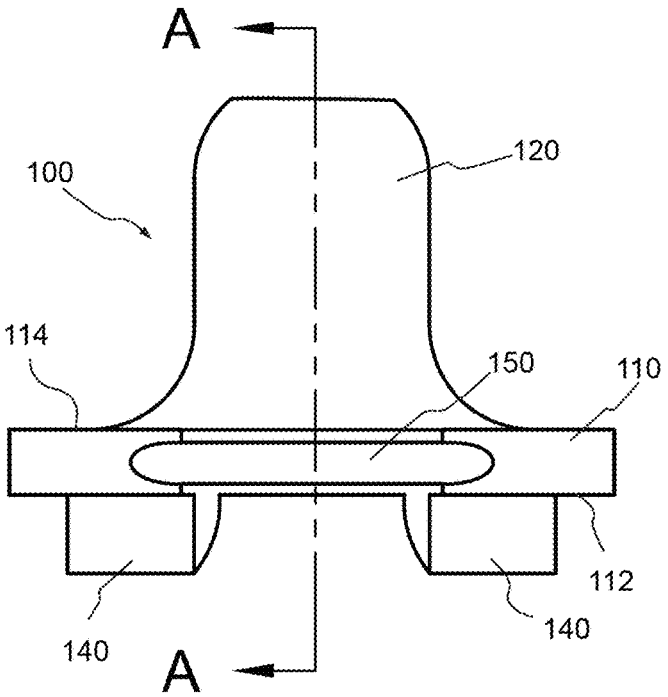
FIG. 7A illustrates another front view of an alternative embodiment of the device of FIG. 2A.
Figure 7B:
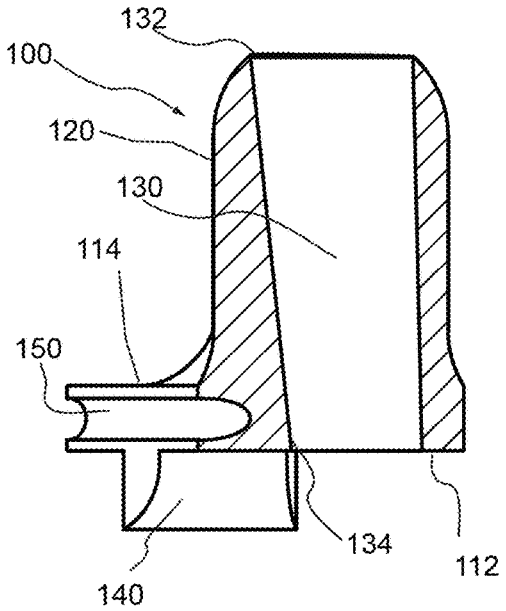
FIG. 7B illustrates a side cross-sectional view along section A-A of the device of FIG. 7A showing an internal surface in the straw passage thereof which transitions from a circular top opening to an oval bottom opening.
Figure 7D:
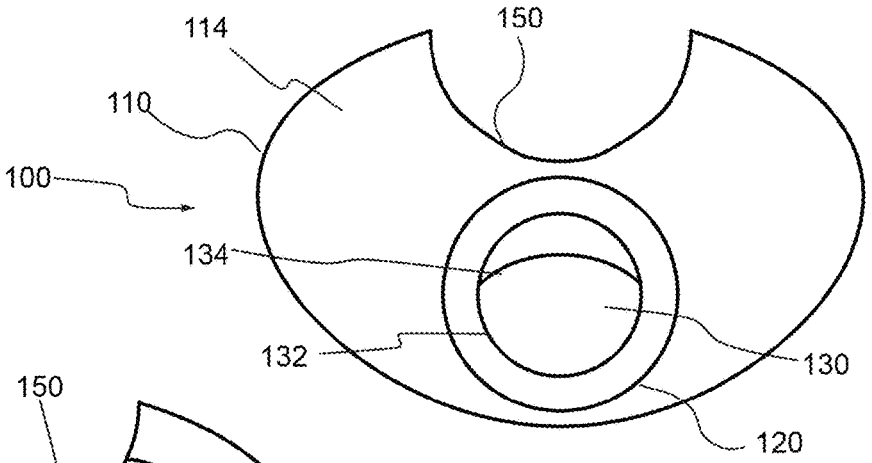
FIG. 7D illustrates a top view of the device of FIG. 7A.
Figure 7C:
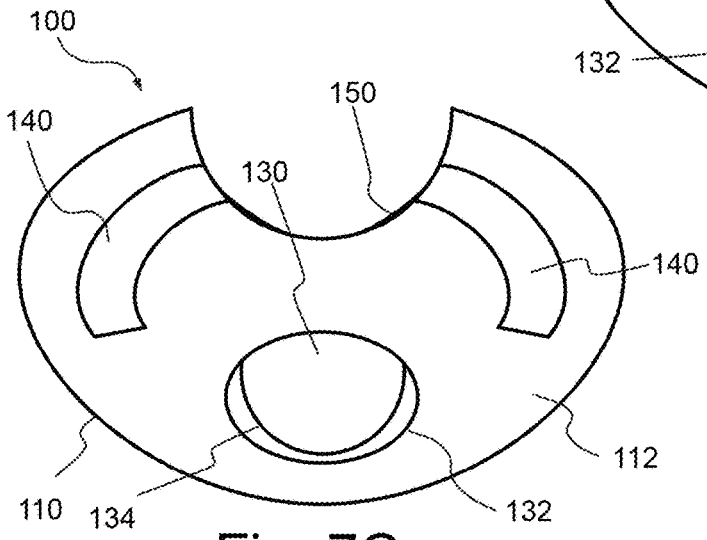
FIG. 7C illustrates a bottom view of the device of FIG. 7A.
Figure 7E:
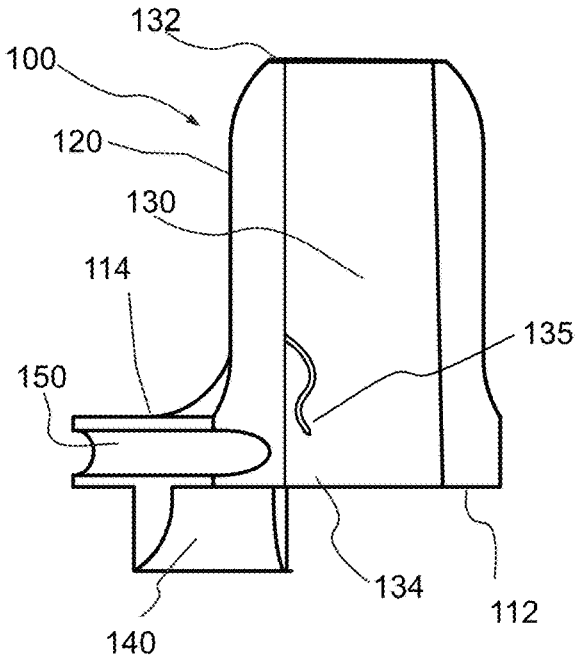
FIG. 7E illustrates a side cutaway view of another alternative embodiment of the device of FIG. 2A including a deformable, flexible abutment member that abuts and may provide a friction fit with a straw.
Figure 7F:
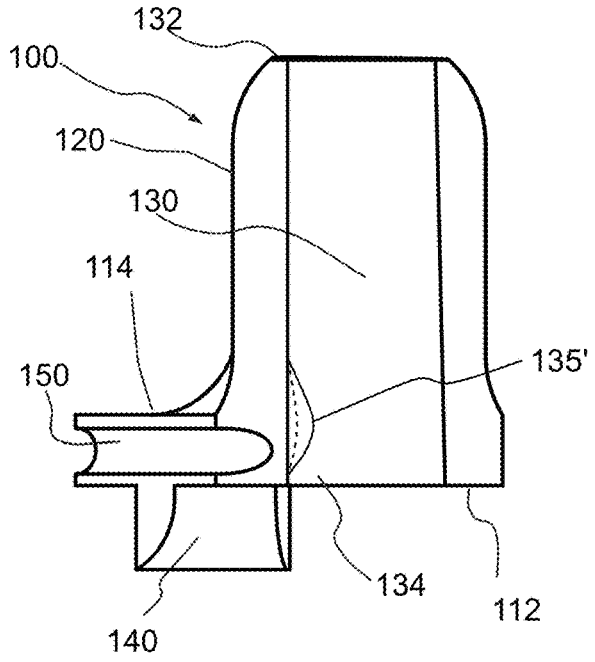
FIG. 7F illustrates a side cutaway view of another alternative embodiment of the device of FIG. 2A including a deformable abutment extension or flange that abuts and may provide a friction fit with a straw.
Figure 8A:
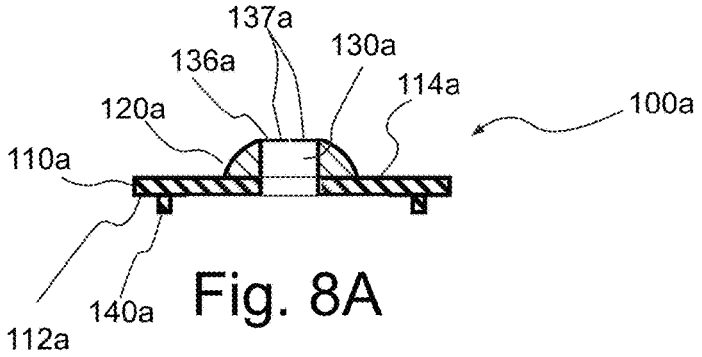
FIG. 8A illustrates a side cutaway of another embodiment of a device hereof including an upper extending member having a lower profile than the embodiment of the device of FIG. 2A.
Figure 8B:
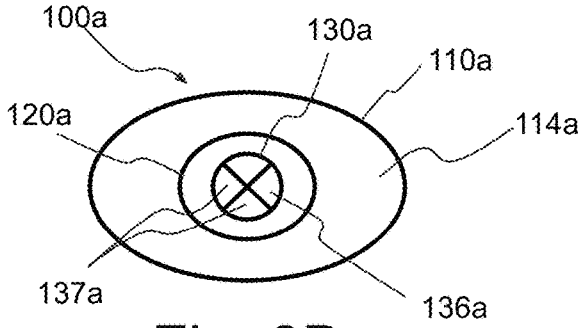
FIG. 8B illustrates a top view of the device of FIG. 8A.
Figure 8C:
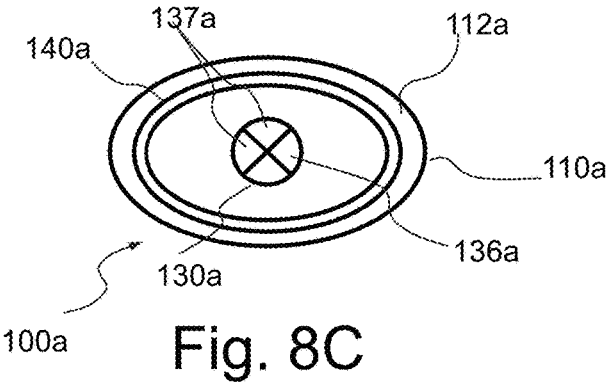
FIG. 8C illustrates a bottom view of the device of FIG. 8A.
Figure 8D:
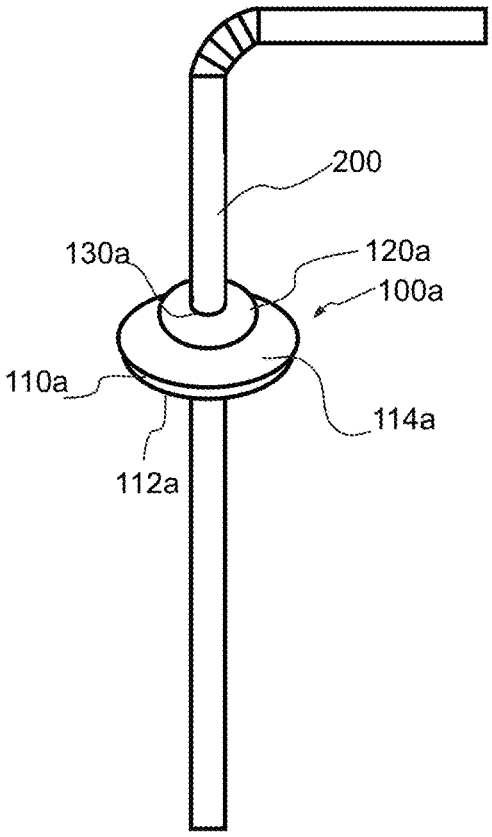
FIG. 8D illustrates a perspective view of the device of FIG. 8A in operative connection with a straw.
Figure 10A:
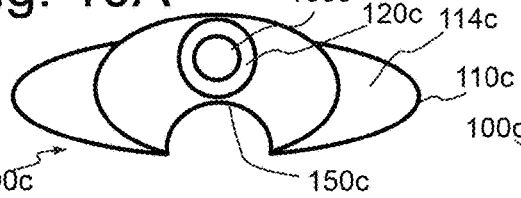
FIG. 10A illustrates a top view of another embodiment of a device hereof including an enlarged base top and bottom area to accommodate use by certain users such as children.
Figure 10B:
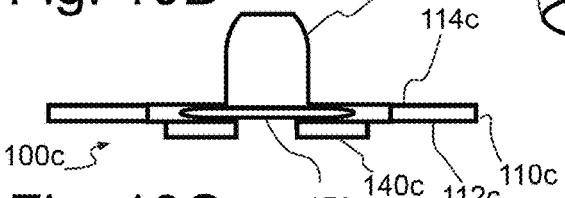
FIG. 10B illustrates a front view of the device of FIG. 10A.
Figure 10C:
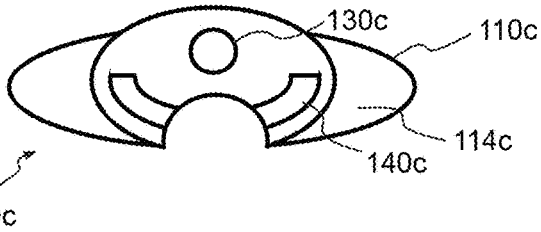
FIG. 10C illustrates a bottom view of the device of FIG. 10A.
Figure 10D:
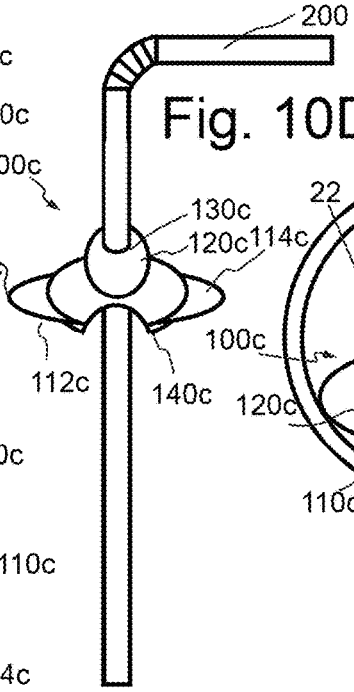
FIG. 10D illustrates a perspective view of the device of FIG. 10A in operative connection with a straw.
Figure 10E:
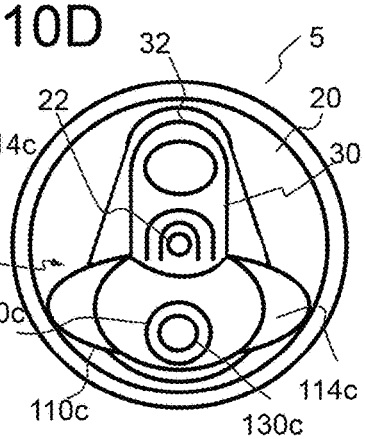
FIG. 10E illustrates a top view of the device of FIG. 10A in operative connection with beverage can.
Figure 11A:
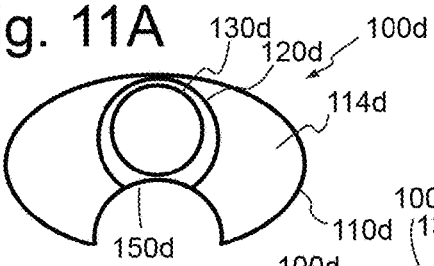
FIG. 11A illustrates a top view of another embodiment of a device hereof including a passage of relatively increased diameter.
Figure 11B:
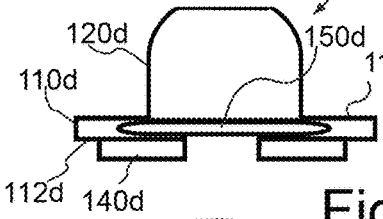
FIG. 11B illustrates a front view of the device of FIG. 11A.
Figure 11C:
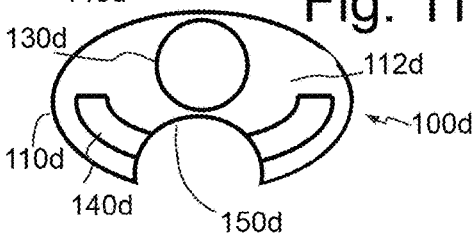
FIG. 11C illustrates a bottom view of the device of FIG. 11A.
Figure 11D:
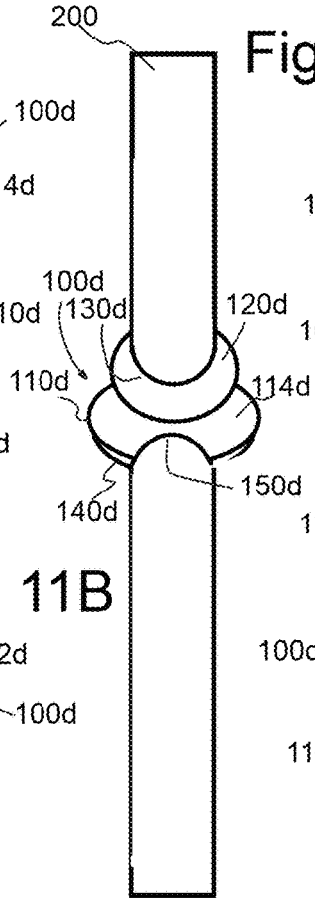
FIG. 11D illustrates a perspective view of the device of FIG. 11A in operative connection with a straw.
Figure 11E:
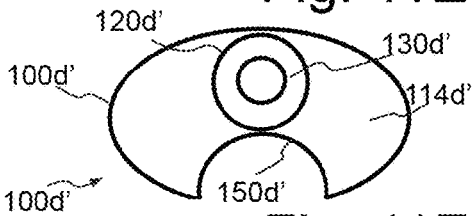
FIG. 11E illustrates a top view of another embodiment of a device hereof including a passage of relatively decreased diameter.
Figure 11F:
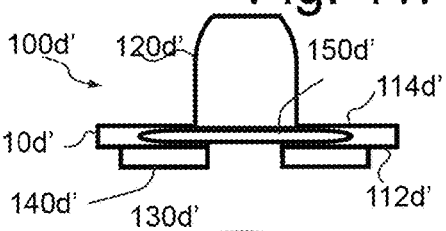
FIG. 11F illustrates a front view of the device of FIG. 11E.
Figure 11G:
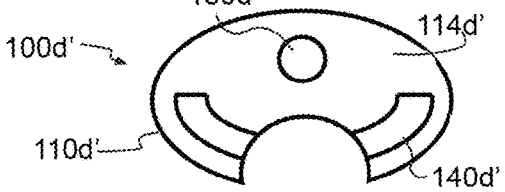
FIG. 11G illustrates a bottom view of the device of FIG. 11E.

FIG. 7E illustrates an embodiment of device 100 in which passage 130 includes one or more flexible, resilient, or spring-like abutment members 135 that extend into passage 130 from an outer wall thereof to abut/contact a straw (not shown in FIG. 7E). Abutment member(s) 135 may, for example, be formed from a deformable or deflectable polymeric or metal material. FIG. 7F illustrates another alternative embodiment of the device 100 including one or more deformable abutment members, extensions, or flanges 135' that extend into passage 130 from an outer wall thereof to abut/contact a straw (not shown in FIG. 7F). Abutment member(s) 135' may, for example, be formed from a deformable polymeric material. In FIG. 7F, abutment member 135' is shown in solid line in a non-deformed or relaxed state and in broken line in a state in which it is deformed radially inward by a straw (not shown) passing through passage 130. In such a deformed state, abutment member 135' will exert a radially inward force upon the straw. Deformable abutment members or retainers 135 and 135' may, for example, provide a friction fit with non-deformable straws or straws that are not readily deformable (for example, metal straws or rigid plastic straws) of various diameters.

Device 100 and other devices hereof are relatively easily and inexpensively manufactured via, for example, injection molding, three-dimensional printing and/or other well-known manufacturing techniques and may be disposable or reusable. Extending member 120 may, for example, differ in length or be absent. However, a relatively longer or larger extending member or straw stem 120 may make device 100 easier to grasp and apply to beverage can 10, particularly for those with limited dexterity).

FIGS. 8A through 8D illustrate another embodiment of a device 100*a* hereof which is similar in operation to device 100 but in which extending member 120*a* is shortened in height (that is, the distance it extends from base 110*a*). In the embodiment of FIGS. 8A through 8D, components or elements of device 100*a* which are similar or the same in construction and/or function as corresponding components or element of device 100 are numbered similarly. However, the designations "a" is added to the end of the reference number. Not all of the components or element of device 100*a* are discussed herein, but reference can be made to the discussion of the corresponding components or element of device 100. In the embodiment of device 100*a*, a single flange 140*a* which continues continuously in a generally oval shape near the perimeter of lower surface 112*a* of base 110*a* is provided to interact with opening 26 of a beverage can 5.

Device 100*a* also includes a straw retention mechanism or retainer 136*a* formed in connection with passage 130*a* to assist in retaining straw 200 therein. In the illustrated embodiment, retainer 136*a* includes a plurality of flexible and resilient, radially inward extending flanges 137*a* (four in the illustrated embodiment) extending from the circumference of passage 130*a*. When straw 200 is passed through the upper opening of passage 130*a*, contact of straw 200 causes flange 137*a* to bend downward and radially outward. The subsequent radially inward force exerted by flexed flanges 137*a* on straw 200 assists in retaining straw 200 in a desired position relative to opening 26 of beverage can 5. The X-shaped (referring the interfaces of flanges 137*a*), deformable retainer 136*a* is similar to the straw opening commonly used in connection with disposable lids, through which a straw may be passed may be provided to aid in accommodating different straw sizes and in retaining the straw in connection with the device.

FIGS. 9A through 9E illustrate another embodiment of a device 100*b* hereof which is similar in operation to device 100 but in which extending member 120*b* is shortened in height. In the embodiment of FIGS. 9A through 9E, components or elements of device 100*b* which are similar or the same in construction and/or function as corresponding components or element of device 100 are numbered similarly. However, the designations "b" is added to the end of the reference number. Not all of the components or elements of device 100*b* are discussed herein, but reference can be made to the discussion of the corresponding components or elements of device 100. In the embodiment of device 100*a*, a single flange 140*a* which continues continuously in a generally oval shape near the perimeter of lower surface 112*a* of base 110*a* is provided to interact with opening 26 of a beverage can 5. In the embodiment of FIGS. 9A through 9E, two flanges 140*b* extend from bottom surface 112*b* of base 110*b* to interact with opening 26 of beverage can 5. Forming device 100*b* with a low profile as illustrated in FIGS. 8A through 9E may, for example facilitate inexpensively forming device 100*b* from disposable and biodegradable materials such as paper or cardboard. In a number of embodiments, base 110*b* was formed from a paper or cardboard material and extending member 120*b* and flanges 140*b* were added thereon or attached thereto using a biodegradable polymeric material.

As, for example, illustrated in FIGS. 10A through 10E, the form of the devices hereof may be changed or adjusted to, for example, better accommodate use by certain users. In the embodiment of FIGS. 10A through 10E, the size or dimensions of the base 110*c* of device 100*c* are increased or extended to facilitate use by users of limited dexterity such as children. The increased size further reduces the risk of a choking hazard when used by small children. As described above, in the embodiment of FIGS. 10A through 10E, components or elements of device 100*c* which are similar or the same in construction and/or function as corresponding components or elements of device 100 are numbered similarly. However, the designations "c" is added to the end of the reference number. Not all of the components or elements of device 100*c* are discussed herein, but reference can be made to the discussion of the corresponding components or elements of device 100.

As illustrated in FIGS. 11A through 11G, the passage of devices hereof may be dimensioned larger or smaller to accommodate different straw diameters. In the embodiments of FIGS. 11A through 11D, passage, opening, or hole 130*d* of device 100*d* is increased in diameter to accommodate straws 200 having a range of larger diameters. In the embodiment, of FIGS. 11E through 11G, hole 130*d*' of device 100*d*' is decreased in diameter to accommodate straws having a range or smaller diameters. The diameters or dimensions of extending members 120*d* and 120*d*' are likewise adjusted to accommodate the diameters of passages 130*d* and 130*d*'. As described above, passages 130*d* and/or 130*d*' may be dimensioned or include a retainer to form an abutting or friction fit with a range of diameters of straws 200. As described above, in the embodiment of FIGS. 11A through 11G, components or elements of devices 100*d* and 100*d*' which are similar or the same in construction and/or function as corresponding components or element of device 100 are numbered similarly. However, the designations "d" or "d" is added to the end of the reference number. Not all of the components or element of devices 100*d* and 100*d*' are discussed herein, but reference can be made to the discussion of the corresponding components or element of device 100.

As illustrated in FIGS. 12A through 12E, a cap or closure mechanism 300 which includes a seating 310 which is dimensioned to fit around and seat an upper portion of extending member 120. Additionally or alternative, cap or closure mechanism 300 may include an extending member 312 (see FIG. 12A) which is dimensioned to enter within passage 130 of device 100. Cap or closure mechanism 300 seals passage 130 when device 100 is not in use. Base 110 of device 100 may likewise form a sealing engagement with opening 26 of lid 20 of beverage can 5. Sealing passage 130 and opening 26 may, for example, help prevent spills and/or help preserve certain fluids within beverage can 5 such as carbonated beverages. As illustrated in FIG. 12A through 12E, cap or closure mechanism 300 may, for example, be attached to (or form integrally or monolithically with) device 10 via a flexible extending member or tether 320. Alternatively, a separate or non-attached cap may be provided. Cap or closure mechanism 300 and tether 320 may, for example, be formed from a resilient polymeric material.

As described above, device 100 and other devices hereof may cooperate with both tab 30 and opening 26 of beverage can 10 to attach to beverage can 10. However, in a number of embodiments, devices hereof may only cooperate with opening 26 to attach to beverage can 10. In that regard, a flange or flanges extending from the bottom surface of the base of a device hereof may, for example, form an adequate connection with opening 26. FIGS. 13A through 13C, for example, illustrate a comparison of device 100 with an embodiment of a device 100*e* hereof including a flange 142*e* or other attachment mechanism extending from the lower surface 112*e* of the base 140*e* which, in a number of embodiments, includes an angled lip 142*e* to cooperate with the lower surface of underside of lid 20 of beverage can 10 surrounding opening 26 to attach device 110*e* to beverage can 5. Such an attachment mechanism may, for example, form a snap fit or friction fit with opening 26. As described above, flexible, rubberlike or elastomeric materials may, for example, be used to provide a corklike suction to seal a device hereof to beverage can 5. Extending member 120*e*, which extends from uppers surface 114*e* of base 110*e*, and passage 130*e* may be identical to extending member 120 and passage 130.

FIGS. 14A through 14D illustrate another embodiment of a device 300 hereof including a base 310. Similar to the embodiments described above, base 310 includes a lower surface 312 which contacts the upper surface of lid 20 when device 300 is placed in operative connection with beverage can 10. A hole or passage 330 through device 300, passing through extending member 320 and through base 310. One or more downward extending flanges 340 extend from base 310 and are, for example, spaced and/or dimensioned to pass into opening 26 of beverage can 10 and cooperate with the walls thereof in securing device 100 to beverage can 10. Device 300 further includes a generally horizontally or radially extending slot or seating 350 which is dimensioned to seat second or forward end 34 of tab 30 as described above.

In the embodiment of FIGS. 14A through 14D, upward extending member 320 extends upward from an upper surface 314 of base 310 to a greater extent than the embodiments described above. Extending member may be used by a user of device 300 in the manner of the straw. In that regard, extending member 320 may be placed in the mouth of the user to drink fluid from beverage can 10. A conduit 400 can, for example, extend from a bottom of passage 330 into can 10 in a manner such that extending member 320 and conduit 400 combine to operate in the manner of a straw.

Flange 340 includes a perimeter with an angled surface which may, for example, form a snap fit with at least a portion of opening 26. A seal or sealing member 318, which may be compressible (such an elastomeric seal, gasket or O-ring) may be provided to help to form a seal with lid 20/opening 26 as well as with any portion of the scored metal defining opening 26 (see FIG. 1A) which remains attached to the perimeter of opening 26 (and extends downwardly into the interior of beverage can 10). A seal may alternatively be formed on or attached to the surface of flange 360 or flange may be formed from a compressible, resilient sealing material. As illustrated in, for example, FIGS. 14C and 14D, lower surface 312 of base 310 is formed with an oval shape in the illustrated embodiment and form a section 312*a* (see FIG. 14C) over which second end 34 of tab 30 passes to be seated in extending slot or seating 350.

The devices and methods hereof provide a hygienic system and methodology for facilitating the use of straws with beverage cans. A number of devices that cooperate with beverage cans for various purpose utilize a mechanism to attach to the lid of a beverage can, allowing the soda or other contents of the beverage can to spread and mix with the top/lid of the beverage can and all of the bacteria/germs found therein. In a number of embodiments, devices hereof are secured within the beverage can opening (and may form a sealing contact therewith) and prevent fluid within the beverage can from passing through the can opening to contact the top/lid of the beverage can.

The foregoing description and accompanying drawings set forth a number of representative embodiments at the present time. Various modifications, additions and alternative designs will, of course, become apparent to those skilled in the art in light of the foregoing teachings without departing from the scope hereof, which is indicated by the following claims rather than by the foregoing description. All changes and variations that fall within the meaning and range of equivalency of the claims are to be embraced within their scope.

What is claimed is:

1. A device for use with a beverage can to secure a straw within the beverage can, comprising:

a base cooperating with an opening of the beverage can to secure the device to the beverage can, and a passage formed through the base which aligns with the opening of the beverage can when the device is secured to the beverage can, the passage being configured to pass a straw therethrough.

2. The device of claim 1 further comprising at least one flange extending from a first surface of the device to cooperate with the opening of the beverage can.

3. The device of claim 2 wherein the base is further configured to cooperate with a tab of the beverage can.

4. The device of claim 3 further comprising at least one seating formed in the base to cooperate with an end of the tab of the beverage can.

5. The device of claim 4 wherein the at least one seating comprises a slot formed in the base.

6. The device of claim 2 further comprising an extending member extending from a second surface of the base, opposite the first surface, wherein the passage is formed through the extending member and the base.

7. The device of claim 6 wherein the passage forms a friction fit with the straw.

8. The device of claim 5 further comprising an extending member extending from a second surface of the base, opposite the first surface, wherein the passage is formed through the extending member and the base.

9. The device of claim 8 wherein the passage forms a friction fit with the straw.

10. The device of claim 2 further comprising a cap to seal the passage.

11. The device of claim 10 wherein the cap is tethered to the device.

12. The device of claim 2 wherein the at least one flange forms a snap fit or a friction fit with the opening of the beverage can.

13. The device of claim 2 wherein the passage is formed to abut and retain the straw or the device further includes an abutment member in operative connection with the passage to abut and retain the straw.

14. The device of claim 13 wherein the passage includes a taper over at least a portion of a surface thereof so that the passage narrows to abut and retain the straw.

15. A method of securing a straw within a beverage can, comprising:

securing a device to the beverage can which comprises a base cooperating with an opening of the beverage can to secure the device to the beverage can and a passage formed through the base which aligns with the opening of the beverage can; and inserting a straw into the passage.

16. The method of claim 15 wherein the device further comprises at least one flange extending from a first surface of the device to cooperate with the opening of the beverage can.

17. The method of claim 16 wherein the base is further configured to cooperate with a tab of the beverage can.

18. The method of claim 17 wherein the device further comprises at least one seating formed in the base to cooperate with an end of the tab of the beverage can.

19. The method of claim 18 wherein the at least one seating comprises a slot formed in the base.

20. The method of claim 16 wherein the device further comprises an extending member extending from a second surface of the base, opposite the first surface, wherein the passage is formed through the extending member and the base.

21. The method of claim 20 wherein the passage forms a friction fit with the straw.

22. The method of claim 19 wherein the device further comprises an extending member extending from a second surface of the base, opposite the first surface, wherein the passage is formed through the extending member and the base.

23. The method of claim 22 wherein the passage forms a friction fit with the straw.

24. The method of claim 16 further comprising placing a cap in connection with the device to seal the passage.

25. The method of claim 24 wherein the cap is tethered to the device.

26. The method of claim 16 wherein the at least one flange forms a snap fit or a friction fit with the opening of the beverage can.

27. The method of claim 16 wherein the passage of the device is formed to abut and retain the straw, or the device further includes an abutment member in operative connection with the passage to abut and retain the straw.

28. The method of claim 27 wherein the passage includes a taper over at least a portion of a surface thereof so that the passage narrows to abut and retain the straw.

29. A device for use with a beverage can, comprising:

a base cooperating with an opening of the beverage can to secure the device to the beverage can, an extending member extending from an upper surface of the base, and a passage formed through the extending member and through the base, the passage aligning with the opening of the beverage can when the device is secured to the beverage can.

30. The device of claim 29 further comprising at least one flange extending from a lower surface of the base to cooperate with the opening of the beverage can.

31. The device of claim 30 wherein an upper end of the passage is configured to be placed in the mouth of a user.

32. The device of claim 31 further comprising a conduit in fluid connection with the passage and extending from the lower surface of the base.

* * * * *